US005913590A

United States Patent [19]

Backus

[11] Patent Number: 5,913,590

[45] Date of Patent: Jun. 22, 1999

[54] METHOD AND APPARATUS FOR DEMOISTURIZING MOIST PRODUCTS

[75] Inventor: Stephanus Michael Marie Backus, Venlo, Netherlands

[73] Assignee: Backus Beheer B.V., Venlo, Netherlands

[21] Appl. No.: 08/918,606

[22] Filed: Aug. 22, 1997

Related U.S. Application Data

[63] Continuation-in-part of application No. PCT/NL96/00085, Feb. 22, 1996.

[51] Int. Cl.[6] ..... F26B 5/14

[52] U.S. Cl. ..... 34/401; 34/216; 34/502

[58] Field of Search ..... 34/203, 216, 217, 34/472, 473, 500, 502, 401, 402

[56] References Cited

U.S. PATENT DOCUMENTS

| | | | |
|---|---|---|---|
| 1,681,556 | 8/1928 | Parker | 15/309.2 |
| 2,338,619 | 1/1944 | Bogaty | 34/506 |
| 2,418,683 | 4/1947 | Wilson | 34/203 |
| 3,307,270 | 3/1967 | Kruger | 34/368 |
| 3,456,357 | 7/1969 | Griffith | 34/401 |
| 3,618,226 | 11/1971 | Goldenberg et al. | 34/640 |
| 4,754,558 | 7/1988 | Milone | 34/216 |
| 4,989,346 | 2/1991 | Wilken | 34/203 |

FOREIGN PATENT DOCUMENTS

| | | |
|---|---|---|
| 0058398 | 8/1982 | European Pat. Off. . |
| 0358136 | 3/1990 | European Pat. Off. . |
| 0567197 | 10/1993 | European Pat. Off. . |
| 877981 | 1/1943 | France . |
| 1321839 | 12/1963 | France . |
| 2439959 | 5/1980 | France . |
| 473130 | 3/1929 | Germany . |
| 238094 | 10/1945 | Switzerland . |
| 314415 | 7/1956 | Switzerland . |
| 1013632 | 12/1965 | United Kingdom . |
| 2053433 | 2/1981 | United Kingdom . |
| 9115129 | 10/1991 | WIPO . |

*Primary Examiner*—Henry Bennett
*Assistant Examiner*—Pamela A. Wilson
*Attorney, Agent, or Firm*—Webb Ziesenheim Logsdon Orkin & Hanson, P.C.

[57] ABSTRACT

A method for drying moist products includes subjecting the products to an irregular movement and collecting and discharging the moisture that is released by the irregular movement of the products. The products are moved in an irregular manner by subjecting them to an air stream which varies over time. In this way the products are dried efficiently and quickly, without risk of damaging the products. An apparatus is provided for carrying out the method, having an assembly for subjecting the products to an irregular movement, an assembly for collecting moisture released by the products and an assembly for discharging the collected moisture, wherein the assembly for irregularly moving the products includes an assembly for generating an air stream that varies over time and guiding this air stream along the products.

16 Claims, 5 Drawing Sheets

METHOD AND APPARATUS FOR DEMOISTURIZING MOIST PRODUCTS

CROSS REFERENCE TO RELATED APPLICATIONS

This application is a continuation-in-part of International Application Number PCT/NL96/00085 filed on Feb. 22, 1996, and designating, inter alia, the United States, which claims priority to Netherlands Patent Application Number 9500360 filed on Feb. 23, 1995.

The invention relates to a method for demoisturizing moist products by imparting an irregular movement to the products and collecting and discharging the moisture that is released by the irregular movement of the products.

Such a method is known, and is especially used in the mechanical processing of products which may not be subjected to high temperatures during demoisturizing or "dewatering" thereof, like vegetables, fruits etc.

Especially for products having a relatively large surface area per unit volume, like lettuce products, the known method of demoisturizing by shaking or vibrating takes a relatively large amount of time, thus decreasing the efficiency of the mechanical processing, and requiring relatively large processing installations for achieving a sufficient throughput. Furthermore, the shaking or vibrating, which usually takes place mechanically, may easily lead to damaging the generally vulnerable lettuce products.

SUMMARY OF THE INVENTION

The invention therefore has for its object to provide a method of the type described above, with which these drawbacks are obviated. According to the invention this is accomplished in that the irregular movement is imparted to the products by subjecting them to an air stream which varies over time. Shaking or vibrating the products by means of an air stream leads to efficient and swift demoisturizing thereof, without the risk of damage to the products.

Variations on the method of the invention which may preferably be applied are described in the dependent claims 2 through 4.

The invention also relates to an apparatus for demoisturizing moist products, comprising means for imparting an irregular movement to the products, means for collecting moisture released by the products and means for discharging the collected moisture.

Such an apparatus is also known and is generally used in mechanical washing and demoisturizing lines for e.g. vegetables or fruit. The known apparatus usually comprises a vibrating or shaking sieve for irregularly moving the products to be demoisturizing or dried, on which the products are advanced through the apparatus, while at the same time the adhering moisture is shaken or vibrated off. The transport capacity of such vibrating or shaking sieves is, however, relatively low, whereas furthermore the danger of damage to the products is considerable.

The invention therefore also has for its object to provide an improved apparatus of this type, which apparatus is characterized according to the invention in that the means for irregularly moving the products comprise means for generating an air stream that varies over time and for guiding the air stream along the products.

Preferred embodiments of the demoisturizing apparatus of the invention form the subject matter of the dependent claims 6 through 16.

BRIEF DESCRIPTION OF THE DRAWINGS

The invention is now illustrated by means of a number of examples, with reference being made to the annexed drawings, in which.

DESCRIPTION OF THE PREFERRED EMBODIMENTS

Figure 1:
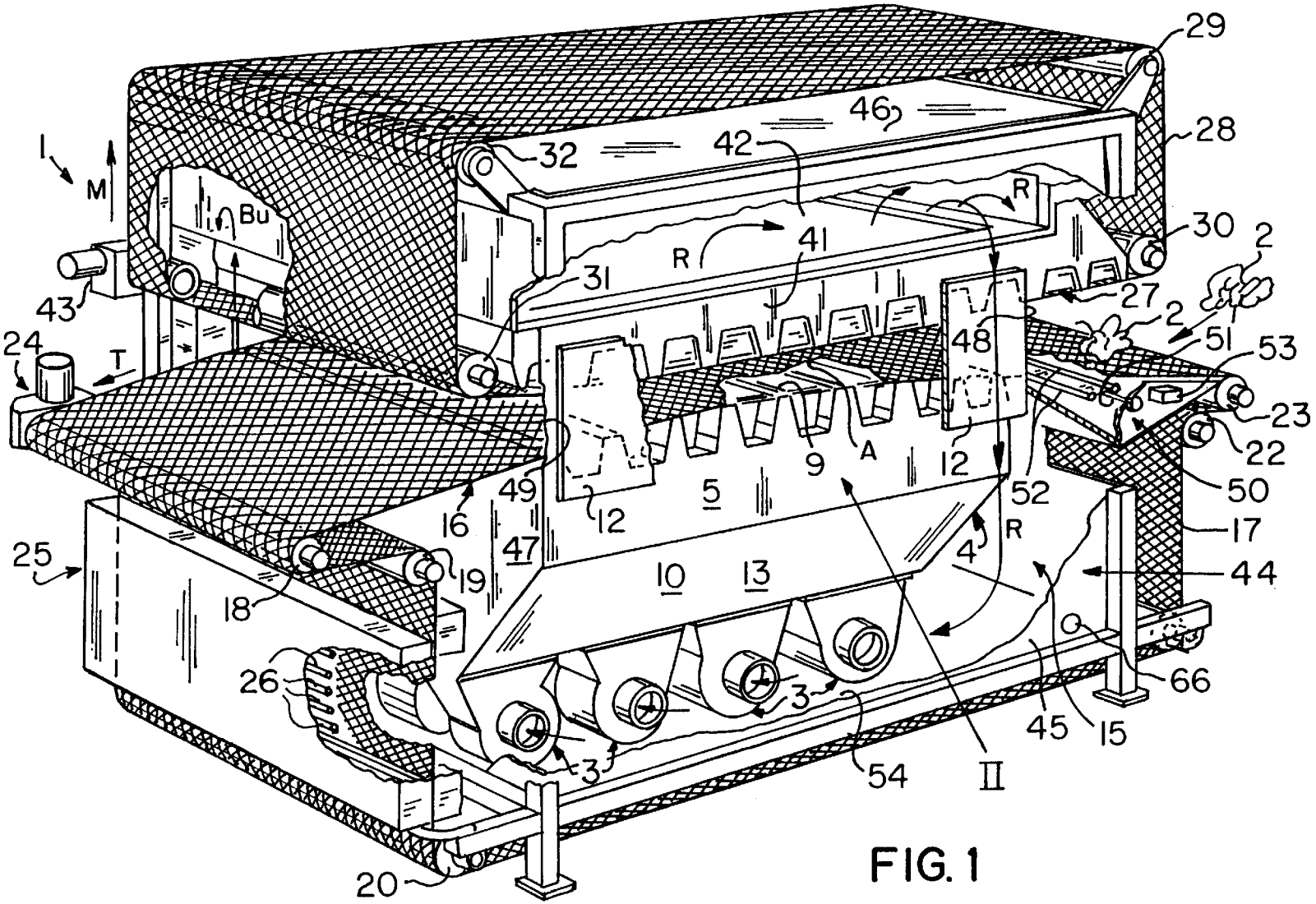
FIG. 1 is a partially broken away perspective view of a first embodiment of the demoisturizing apparatus according to the invention.

An apparatus 1 for demoisturizing or "dewatering" moist products 2 (FIG. 1) comprises means for irregularly moving the products 2, means for collecting moisture released by the products, and means for discharging the collected moisture. The means for irregularly moving the products 2 comprise means for generating a plurality of successive air streams A that varies over time and for guiding each air stream along the products 2, as well as means 16 for transporting the products 2 along the air stream generating means in accordance with the arrow T, substantially perpendicular to an air stream A.

Figure 2:
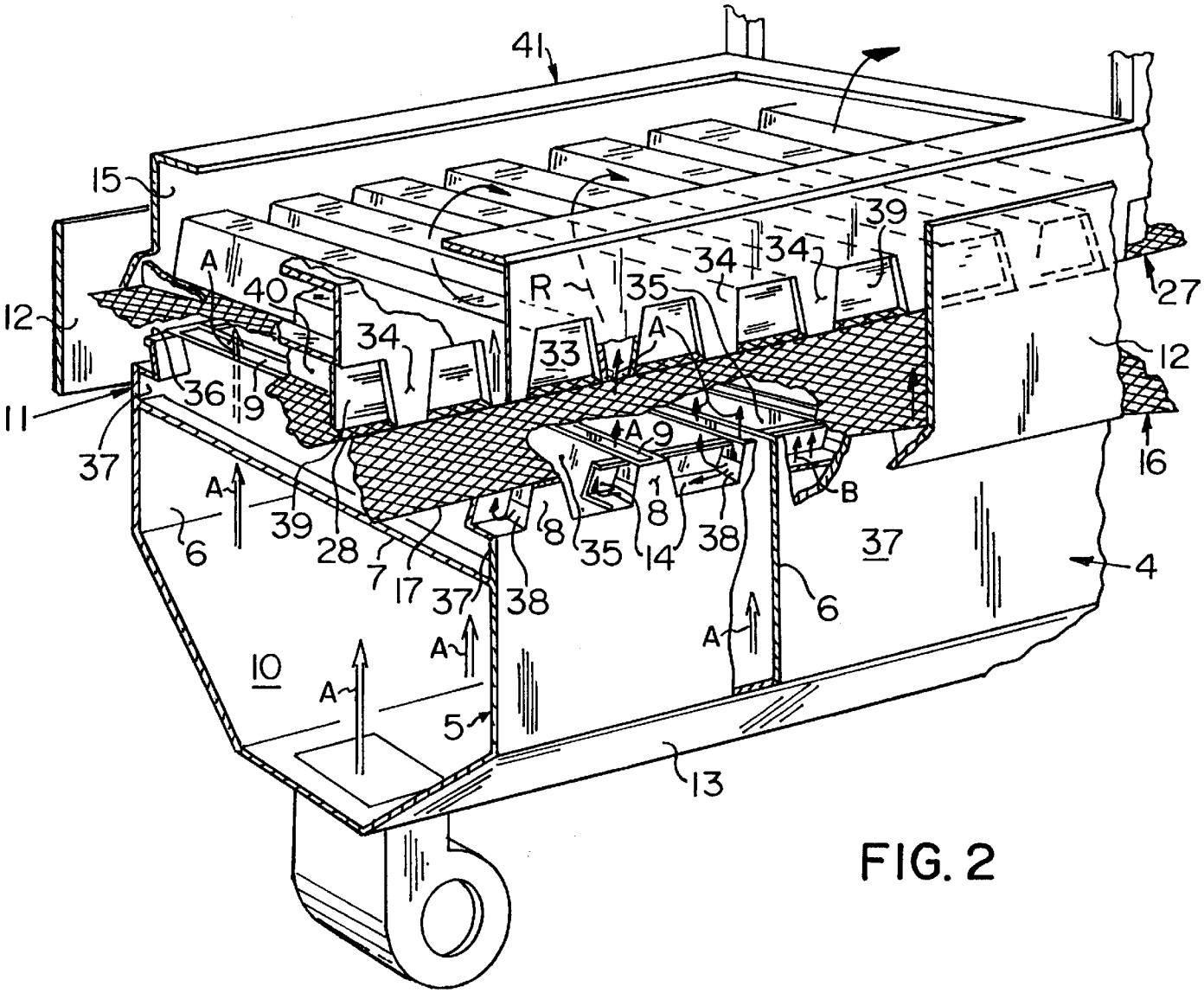
FIG. 2 is a partially broken away perspective detail view along the arrow II in FIG. 1.

The means for generating an air stream A and for guiding it along the products 2 comprise a plurality of pressure fans or compressors 3, each of which is connected with its pressure side to a lower part 5 of an inner housing 4. The lower part 5 comprises sloped walls 13 defining a diffuser part 10, which is further bordered by vertical walls 6 and a top wall 7 (FIG. 2). The top wall 7 of the lower casing 5 comprises crenelles 8, which are open at the top and thus form discharge openings 9. These discharge openings 9 extend over substantially the entire width of the transport means 16. The discharge openings 9 are spaced in the direction of transport T, whereby the products 2 which are supplied by the transport means 16 will be led through an air stream A several times during transport through the apparatus 1. Thus the products 2 are in fact subjected to an air stream A which varies over times viz. the full force of the air stream A at the discharge openings 9, followed by a "calm" part of the transport means 16. The transport means 16 incidentally comprise an air permeable belt conveyer 17 which is moveable along the discharge openings 9, wherein each belt conveyor has a curvature, formed by arched-shaped crenelles 8 wherein each belt conveyer has a curvature, formed by arched-shaped crenelles 8. This belt conveyer 17 is guided over guide rolls 18–23, and driven by a motor 24.

As the products 2 are thus subjected to an air stream which varies during transport through the apparatus 1, they will rove through the apparatus 1 along a bouncing trajectory, being lifted from the belt conveyer 17 by each air stream A, and subsequently falling back at the following "calm" portion. In order to properly beat loose the moisture present in the products 2, the demoisturizing apparatus 2 further comprises means 27 spaced from the discharge openings 9 in the direction of the air stream A for blocking the upward movement of the products 2. These blocking means 27 comprise a moisture absorbing, air permeable belt conveyer 28 guided along guide rolls 29–32, which may be moved with the lower belt conveyer 17 in the direction of the arrow M, and is driven by a motor 43. As this conveyer 28 blocks the upward movement of the products 2 in the air stream A, the moisture is beaten from the products 2, and subsequently absorbed in the moisture absorbing conveyer 28.

Suction openings 33 are arranged behind the moisture absorbing conveyer 28 when seen in the direction of the air stream A, these openings in turn being connected to the means for generating the air stream A. Through these suction openings 33 the moisture that is absorbed in the belt conveyer 28 is drawn off, after which it condenses against the inside of an outer housing 44 surrounding the inner housing 4. The return air R is further led back to the fans or compressors 3. The number of suction openings 33 substantially corresponds with the number of discharge openings 9. The suction openings 33 and the discharge openings 9 incidentally are not arranged opposite each other, but are staggered in the direction of transport T. Also, the air velocity at the suction openings 33 need not be equal to the discharge velocity of the air over the openings 9. The discharge velocity may for instance be selected twice as high as the suction velocity, by selecting a total area of the discharge openings 9 which is approximately half the total area of the suction openings. A demoisturizing apparatus 1 which has proven to be useful in practice may have a discharge velocity in the order of 10 to 70 m/s, preferably 40 m/s, while the suction velocity is 5 to 35 m/s, preferably 20 m/s.

Between the crenelles 8 the lower casing 5 comprises separation walls 37, which are placed somewhat inwardly of the sidewalls 6 of the lower casing 5, and which divide the space between the crenelles 8 in receptor bins 35 located at the inside, and bypass ducts 14 having discharge openings 36 for cleaning bypass air BL at the outside. This bypass air BL, which is led from the lower casing 5 through openings 38 to the bypass duct 14, and is finally blown out through the openings 36 along the edge of the conveyer 17, serves to prevent the product from assembling along the edge of the conveyer 17 and thus being caught and smeared between the conveyer 17 and the fixed parts of the apparatus 1. Such smearing of the product would in fact lead to the development of bacteria, which might affect the remainder of the products 2 transported through the apparatus 1. It should be noted that the demoisturizing apparatus 1 will usually be installed at the end of a cleaning line for the products 2, so that products leaving the apparatus 1 will generally not be cleaned any further.

The receptor bins 35 between the walls 37 also serve to receive products which may fall through the belt conveyer 17, and to prevent these parts of the products from being smeared between the belt conveyer 17 and the fixed parts of the apparatus 1. Furthermore, the bins 35 as a matter of course receive part of the moisture released by the products 2. To further prevent the development of bacteria the belt conveyer may be led through a cleaning installation 25 in its return path, in which for instance a cleaning fluid is sprayed onto the belt by means of spray tubes 26. Cleaning by means of for instance air or UV radiation is also a possibility. It will further be clear that the upper belt conveyer 28 may be subjected to a similar cleaning operation.

The suction openings 33 are constructed in a similar manner as the discharge openings 9, and are also arranged in crenelles 34, which form part of the bottom wall of an upper part 41 of the inner housing 4. The spaces between the crenelles 34 serve as receptor areas 40, while the walls 39 arranged between the crenelles 34 serve as guidance for the upper belt conveyer 28. In order to maintain a distance between the products 2 and the edge of the conveyer 28, the suction openings do not extend over the full width of the upper conveyer 28. Thus the products 2 are sucked laterally inward somewhat. The moist air drawn off by the suction openings 33 is collected in the upper part 41 of the housing and is led back from there through an opening 42 as return air to the fans or compressors 3, thus forming a closed loop system. The moisture present in the return air condenses against the inside of the outer housing 44. It is of course also possible to construct the apparatus 1 as an open loop system, in which the air that is drawn off is dried and discharged, and the compressors 3 continuously suck in fresh air.

In order to allow cleaning of the belt conveyer 17, 28 and the various parts 5, 41 of the inner housing 4, an opening 11 is arranged at both sides between the lower part 5 and the upper part 41, which opening is closed off during operation of the apparatus 1 by a door 12, for instance an upwardly and downwardly moveable sliding door. Thus the parts 5, 41 of the inner housing 4 form a closed air duct.

The inner housing 4 constituted by the lower part 5 and the upper part 41 is completely surrounded by an outer housing 44, which is formed by side walls 45, a bottom 54, a top 46 and front and rear walls 47, 48. Openings 49 are arranged in the front and rear walls 47, 48 for letting through the transport means 16 and moveable blocking means 27. In the outer housing 44 the moisture from the return air R, which mostly condenses against the walls of the housing, is collected and eventually discharged via a vent 66 through the outer housing 44.

Both the guiding surfaces for the belt conveyers 17, 28 formed by the lower crenelles 8 and the upper crenelles 34 respectively, are arched. This curvature allows the belt conveyers 17 and 28, respectively to be properly tensioned, and thus the risk of the conveyers "floating" on the air stream A is minimized.

In order to effect a first separation of moisture from the products 2, the apparatus 1 may further comprise mechanical means 50 for irregularly moving the belt conveyer 17 and the products 2 lying thereon. These mechanical moving means 50 comprise a shaft 51, carrying two parallel, eccentric knocking members 52, which will lift the belt conveyer 17 somewhat during rotation of the shaft 51, after which the conveyer will regain its original shape as a result of the tension therein. Thus, a considerable vibrating or shaking movement is imparted to the products. As the belt 17 is relatively light weight when compared to for instance a vibrating or shaking sieve, it can be subjected to fairly considerable accelerations perpendicularly to its plane; thus allowing an effective first separation of the moisture and products. The moisture released during this first separation is directly collected in the outer housing 44.

As the belt conveyers 17, 28 and the mechanical knocking means 50 are each driven separately, the speed of each of these parts may be independently selected. Thus, an optimum operation of the apparatus 1 can be guaranteed for each kind of product. The blowing and suction force of the compressors 3 may also be separately selected. The amount of moisture separation by the knocking mechanism 50 may further be affected by the dimensions of the knocking members 52. Instead of the shown shaft with knocking members arranged on both sides, an elliptical or otherwise eccentrical shaft 50 may of course also be employed.

Figure 3:
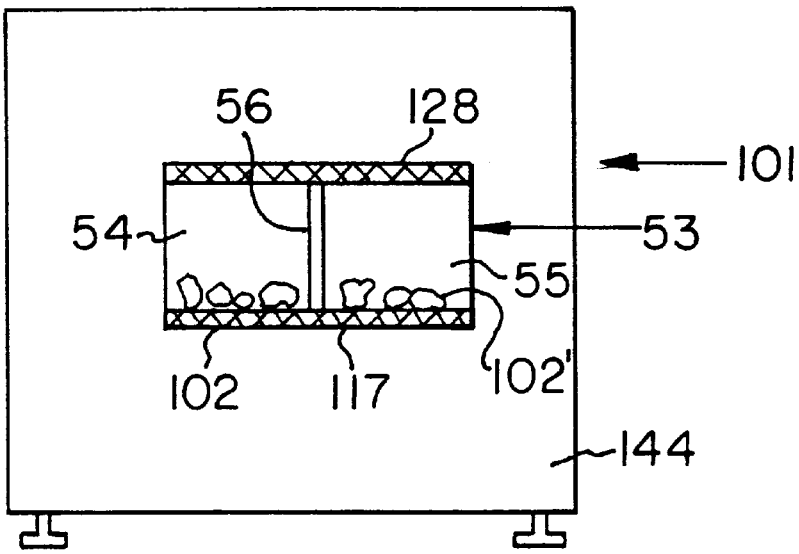
FIG. 3 is a front view of a second embodiment of the demoisturizing apparatus.

In an alternative embodiment of the demoisturizing apparatus 101 (FIG. 3), the space 53 between the upper and lower conveyers 128 and 117, respectively, may be divided into several parallel demoisturizing lanes 54, 55 by one or more substantially vertical divider walls (only one wall 56 shown here) extending in the direction of transport T over substantially the entire length of the conveyers 117, 128. In this way, a single demoisturizing apparatus may be used for demoisturizing various different products 102, 102' simultaneously. Care should of course be taken to ensure that the products to be demoisturized simultaneously have somewhat similar characteristics, since the operating conditions will necessarily be identical in the various demoisturizing lanes 54, 55 formed by the divider wall(s) 56.

Figure 4:
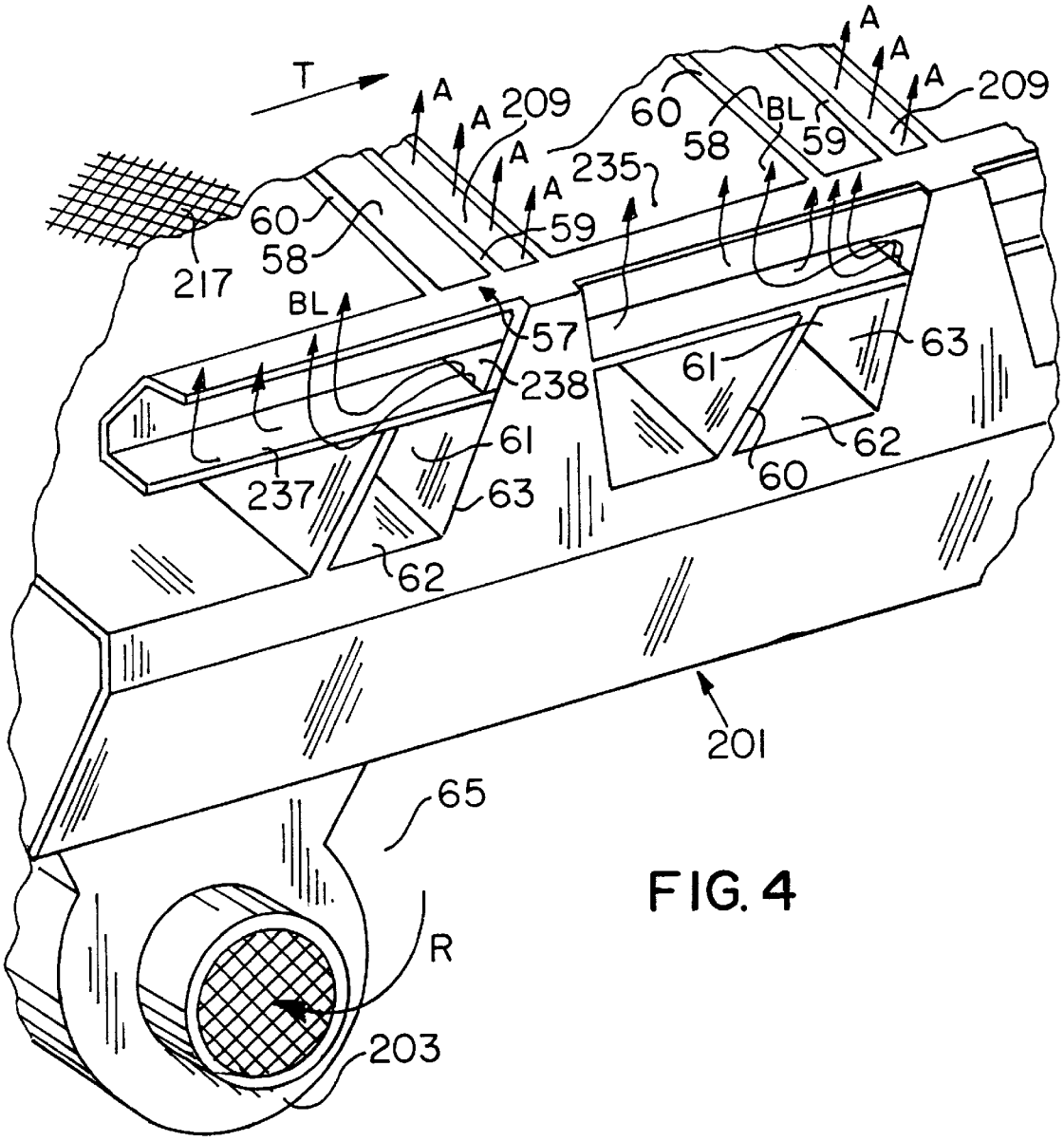
FIG. 4 is a partially broken away perspective detail view of a third embodiment of the demoisturizing apparatus of the present invention.
Figures 5A, 5B:
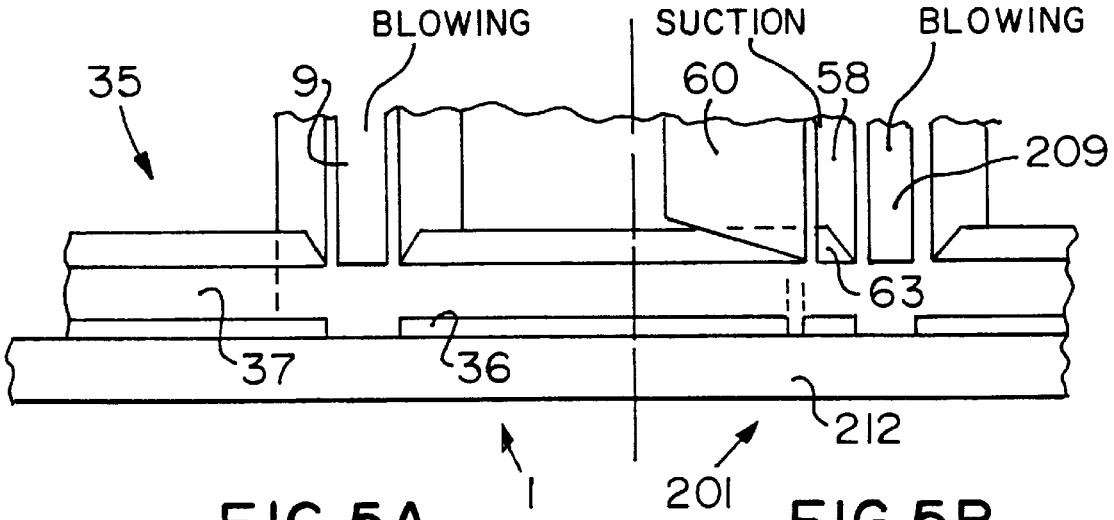
FIGS. 5A and 5B are partial top views of the discharge openings of the first and third embodiments of the demoisturizing apparatus, respectively.
Figures 6A, 6B:
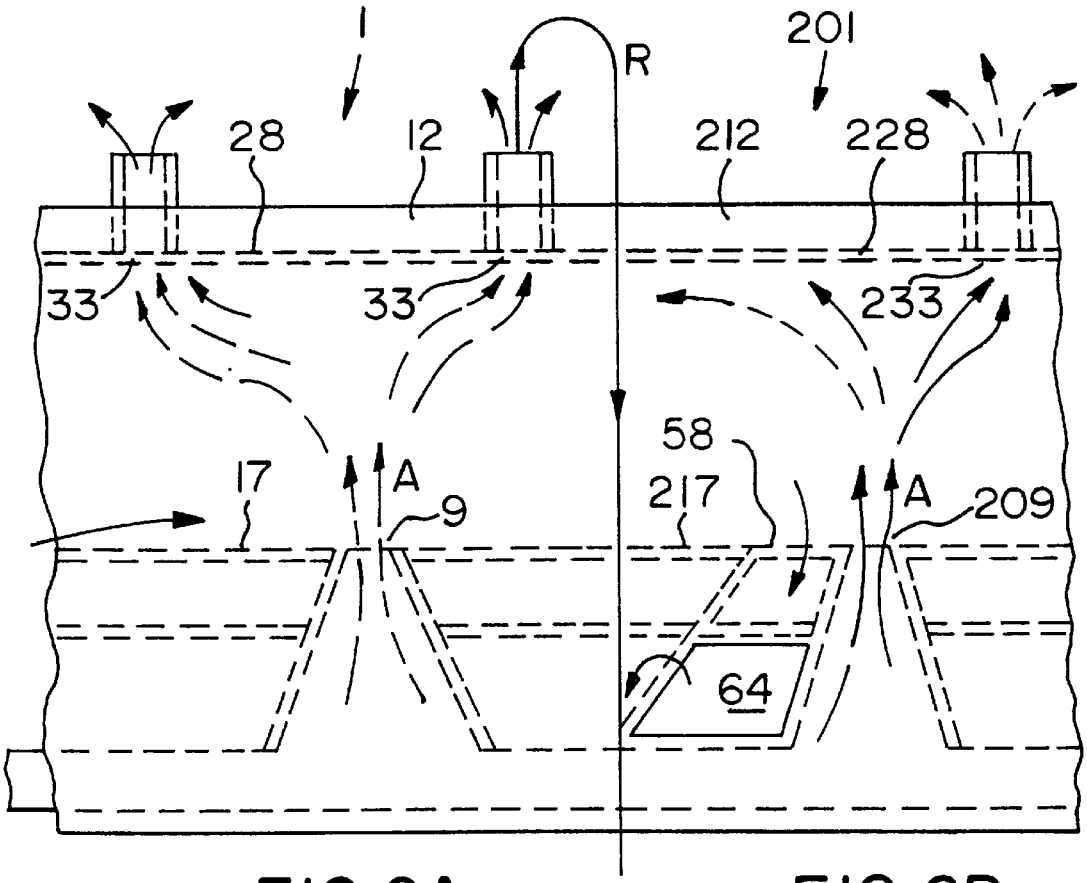
FIGS. 6A and 6B are partial side views corresponding with FIGS. 5A and 5B.

In yet another embodiment of the demoisturizing apparatus 201 (FIG. 4), there are means 57 for temporarily holding the products 202 during their irregular movement through the apparatus 201. These holding means 57 comprise suction slots 58 arranged in front of respective discharge openings 209. Each suction slot 58 is bounded on the downstream side by a transverse wall 59 separating the slot 58 from the adjacent discharge opening 209, and on the upstream side by a transverse wall 60 separating the slot 58 from the adjacent receptor bin 235. The lower end of the space 61 defined between these walls 59 and 60 is closed by a bottom 62, whereas this space 61 is open at the sides 63. The open sides 63 communicate with the space 65 enclosed between the inner housing 204 and the outer housing 244 through which the return air stream R flows. To this end the door 212 may comprise a plurality of openings 64, each of which is aligned with the open side 63 of a respective suction slot space 61 when the door 212 is closed (FIG. 6B).

Figure 7:
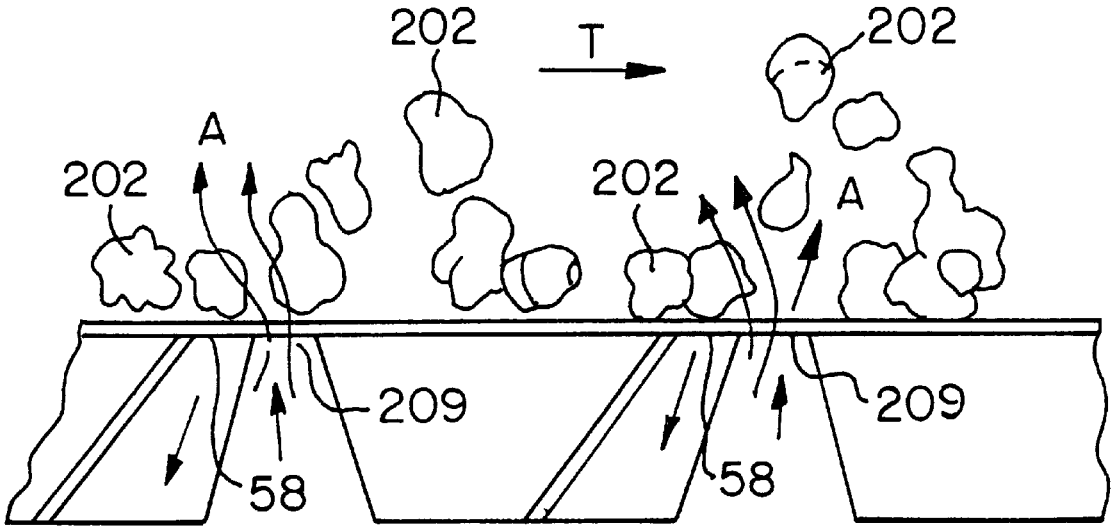
FIG. 7 is a schematic side view illustrating the functioning of the third embodiment.

The lower than ambient pressure in the return air space 65, which is the result of the air stream generating means 203 drawing in the return air, leads to suction being applied to the slots 58. This suction in turn serves to tightly hold the products 202, which have fallen back on the lower conveyer 217 in the "calm" portion of their bouncing trajectory. When the products 202 are subsequently moved in front of the next discharge opening 209, while they are still partly being held by the suction from the slot 58, part of the moisture present on the products 202 will be blow off by the air stream A, before the products 202 are released by the suction slot 58 and blown toward the upper conveyer 228 (FIG. 7). Thus, the demoisturizing action is increased, due to the fact that the moisture on the products 202 is less sensitive to the suction being applied through the slot 58 than the (relatively lightweight) products 202 themselves. Furthermore, the suction will also remove part of the moisture from the underside of the products 202, thus further boosting the demoisturizing action.

The demoisturizing apparatus of the invention may for instance be incorporated in a mechanical washing and demoisturizing line for e.g. lettuce products, in which the lettuce products are first cut, and subsequently go through a number of baths, in which they are washed, with the products being dried and disinfected in between, after which subsequent demoisturizing may take place in the demoisturizing apparatus of the invention, in which for instance the moisture content is reduced from approximately 30% to approximately 10%, after which the products are finally dried to a moisture content of for instance approximately 2% in a tunnel drier as described in applicant's earlier European patent application bearing publication number EP-A-0 567 197.

I claim:

1. A method for demoisturizing moist products comprising the steps of:

imparting an irregular movement to the products;

collecting and discharging the moisture that is released by the irregular movement of the products; and imparting the irregular movement to the products by subjecting them to an air stream which varies over time.

2. The method as claimed in claim 1, including transporting the products through a plurality of successive air streams, directed substantially perpendicularly to their direction of transport.

3. The method as claimed in claim 1, including releasing the moisture from the products by blocking the movement of the products in the air stream.

4. The method as claimed in claim 1, wherein before being subjected to the air stream, an irregular movement is mechanically imparted to the products.

5. An apparatus for demoisturizing moist products, comprising:

means for imparting an irregular movement to the products;

means for collecting moisture released by the products; and means for discharging the collected moisture, wherein the means for irregularly moving the products comprise means for generating an air stream that varies over time and for guiding the air stream along the products.

6. The demoisturizing apparatus as claimed in claim 5, wherein the means for irregularly moving the products comprise means for transporting the products along the air stream generating means, substantially perpendicularly to the air stream.

7. The demoisturizing apparatus as claimed in claim 5, wherein the air stream generating means comprise at least one discharge opening, and the transport means comprise at least one air permeable belt conveyer that is moveable along the discharge opening.

8. The demoisturizing apparatus as claimed in claim 7, including means for holding the products on the belt conveyer.

9. The demoisturizing apparatus as claimed in claim 8, wherein the holding means comprise at least one suction slot arranged upstream and adjacent the at least one discharge opening.

10. The demoisturizing apparatus as claimed in claim 7, including means for blocking the movement of the products, spaced above the discharge opening in the direction of the air stream.

11. The demoisturizing apparatus as claimed in claim 10, wherein the blocking means comprise a moisture absorbing and air permeable belt conveyer.

12. The demoisturizing apparatus as claimed in claim 11, including at least one suction opening connected to the air stream generating means and arranged behind the moisture absorbing belt conveyer when seen in the direction of the air stream.

13. The demoisturizing apparatus as claimed in claim 12, including a plurality of discharge openings and a corresponding number of suction openings staggered in the direction of transport with respect to the discharge openings.

14. The demoisturizing apparatus as claimed in claim 7, including at least one divider wall extending in the direction of transport and defining at least two parallel demoisturizing lanes.

15. The demoisturizing apparatus as claimed in claim 7, including means arranged upstream of the discharge opening for irregularly moving the belt conveyer moveable along the discharge opening.

16. The demoisturizing apparatus as claimed in claim 7, wherein each belt conveyor has a curvature, formed by arched-shaped crenelles.

* * * * *